US010111457B2

(12) United States Patent
Benjak et al.

(10) Patent No.: US 10,111,457 B2
(45) **Date of Patent: *Oct. 30, 2018**

(54) TOBACCO MATERIAL AND TREATMENT THEREOF

(71) Applicant: British American Tobacco (Investments) Limited, London (GB)

(72) Inventors: Denis Benjak, Rio de Janero (BR); Pedro Field, Rio de Janero (BR); Alcindo Glesse, Rio de Janero (BR); Matthias Link, Hamburg (DE)

(73) Assignee: British American Tobacco (Investments) Limited, London (GB)

( * ) Notice: Subject to any disclaimer, the term of this patent is extended or adjusted under 35 U.S.C. 154(b) by 174 days.

This patent is subject to a terminal disclaimer.

(21) Appl. No.: 15/033,281

(22) PCT Filed: Oct. 30, 2014

(86) PCT No.: PCT/GB2014/053224

§ 371 (c)(1),
(2) Date: Apr. 29, 2016

(87) PCT Pub. No.: WO2015/063486

PCT Pub. Date: May 7, 2015

(65) Prior Publication Data

US 2016/0262445 A1 Sep. 15, 2016

(30) Foreign Application Priority Data

Oct. 31, 2013 (GB) ..... 1319288.5

(51) Int. Cl.
*A24B 15/18* (2006.01)
*A24B 9/00* (2006.01)
(Continued)

(52) U.S. Cl.
CPC ..... *A24B 15/183* (2013.01); *A24B 3/04* (2013.01); *A24B 3/12* (2013.01); *A24B 3/18* (2013.01);
(Continued)

(58) Field of Classification Search
None
See application file for complete search history.

(56) References Cited

U.S. PATENT DOCUMENTS 3,070,098 A 12/1962 Tempel et al.
4,150,677 A * 4/1979 Osborne, Jr. ..... A24B 15/24 131/275

(Continued)

FOREIGN PATENT DOCUMENTS

CN 1088414 A 6/1994
CN 1133694 A 10/1996

(Continued)

OTHER PUBLICATIONS

International Searching Authority "International Search Report and The Written Opinion" issued in connection to International Application No. PCT/GB2014/053224, 10 pages, dated Feb. 10, 2015.

(Continued)

*Primary Examiner* — Dennis R Cordray
(74) *Attorney, Agent, or Firm* — McKee, Voorhees & Sease, PLC

(57) ABSTRACT

A tobacco material and a process for the treatment of tobacco are provided. The process comprises securing the tobacco material within a moisture-retaining material and exposing the tobacco material to an ambient processing temperature of at least about 45° C., with the tobacco having a packing density of at least 200 kg/m$^3$ on a dry matter weight base at the start of the process and a moisture content of between about 10% and 15.5%. The treated tobacco (Continued)

material has an aerobic plate count of up to about 1000 CFU/g.

25 Claims, 1 Drawing Sheet

(51) Int. Cl.
*A24B 15/24* (2006.01)
*A24B 3/04* (2006.01)
*A24B 3/12* (2006.01)
*A24B 3/18* (2006.01)

(52) U.S. Cl.
CPC ..... *A24B 9/00* (2013.01); *A24B 15/18* (2013.01); *A24B 15/24* (2013.01)

(56) References Cited

U.S. PATENT DOCUMENTS

| | | | | |
|---|---|---|---|---|
| 4,343,317 | A | 8/1982 | Bokelman | |
| 4,366,824 | A | 1/1983 | Rainer et al. | |
| 4,556,073 | A | 12/1985 | Gravely et al. | |
| 4,557,280 | A | 12/1985 | Gravely et al. | |
| 4,917,161 | A | 4/1990 | Townend | |
| 6,048,404 | A | 4/2000 | White | |
| 6,202,649 | B1 | 3/2001 | Williams | |
| 6,298,858 | B1 | 10/2001 | Coleman et al. | |
| 7,537,013 | B2 | 5/2009 | Nelson et al. | |
| 8,863,756 | B2 * | 10/2014 | Andersen | A23G 4/068 131/352 |
| 2005/0066986 | A1 | 3/2005 | Nestor et al. | |
| 2008/0156338 | A1 | 7/2008 | Winterson et al. | |
| 2012/0318287 | A1 | 12/2012 | Andersen | |

FOREIGN PATENT DOCUMENTS

| | | | |
|---|---|---|---|
| CN | 2583992 | Y | 11/2003 |
| CN | 1927660 | A | 3/2006 |
| CN | 1947605 | A | 4/2007 |
| CN | 101531551 | A | 9/2009 |
| CN | 102920009 | A | 2/2013 |
| CN | 102920010 | A | 2/2013 |
| CN | 102154062 | B | 4/2013 |
| CN | 102757866 | B | 6/2014 |
| CN | 103120359 | B | 11/2014 |
| JP | 52120199 | A | 10/1977 |
| TW | 201242522 | | 11/2012 |
| WO | 2013098920 | A1 | 6/2012 |
| WO | 2013115106 | A1 | 8/2013 |

OTHER PUBLICATIONS

Shi, et al., "Changes in TSNA Contents During Tobacco Storage and the Effect of Temperature and Nitrate Level on TSNA Formation", Coresta Agro-phyto Joint Meeting, Oct. 12-17, 2013, 32 pages.

* cited by examiner

TOBACCO MATERIAL AND TREATMENT THEREOF

CROSS-REFERENCE TO RELATED APPLICATIONS

This application is the National State of International Patent Application Serial No. PCT/GB2014/053224, filed Oct. 30, 2014, which claims priority to and benefits of Great British Patent Application Serial No. 1319288.5 filed Oct. 31, 2013, each of which is herein incorporated by reference in its entirety for all purposes.

FIELD

The present invention relates to tobacco material and a process for the treatment of tobacco.

BACKGROUND

After harvesting, tobacco material can be cured to prepare the leaf for consumption. The tobacco material may be further treated, for example by aging or fermentation, to enhance the organoleptic properties of the tobacco. However, these processes can be lengthy and the quality of the resulting tobacco material can be variable. In addition, the microbial content or microbial composition of the tobacco material may increase or alter during these processes.

SUMMARY

According to a first aspect, a process is provided for the treatment of tobacco material wherein the treated tobacco material has an aerobic plate count of up to about 1000 CFU/g, optionally up to about 100 CFU/g, the process comprising securing tobacco material within a moisture-retaining material and exposing the tobacco material to an ambient processing temperature of at least about 45° C., wherein the tobacco material has a packing density on a dry matter weight base of at least 200 kg/m$^3$ at the start of the process and has a moisture content of between about 10% and 15.5% before and during treatment.

According to a second aspect, tobacco material produced according to the first aspect is provided.

According to a third aspect, a tobacco material secured within a moisture-retaining material is provided, wherein the tobacco material has been exposed to an ambient temperature of at least about 45° C., has a packing density on a dry matter weight base of at least 200 kg/m$^3$ and a moisture content of between about 10% and 15.5%, and wherein the tobacco material has an aerobic plate count of up to about 1000 CFU/g, optionally up to about 100 CFU/g.

According to a fourth aspect, a smoking article or a smokeless tobacco product comprising the tobacco material according to the second or third aspects is provided.

BRIEF DESCRIPTION OF THE FIGURES

For the purposes of example only, embodiments of the invention are described below with reference to the accompanying drawings, in which.

DETAILED DESCRIPTION

Figure 1:
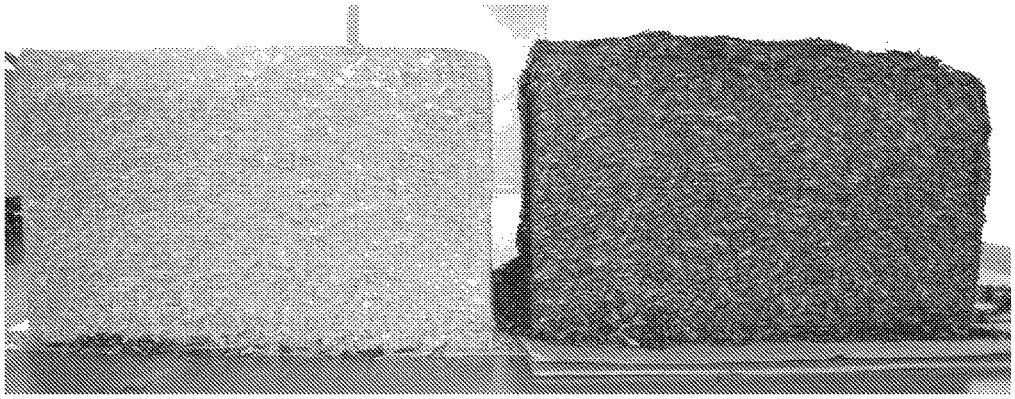
FIG. 1 shows tobacco before (left) and after (right) treatment by a process according to some embodiments of the invention.

The present invention relates to a tobacco material and a process for the treatment of tobacco material.

As used herein, the term 'treated tobacco' refers to tobacco that has undergone the treatment process, and the term 'untreated tobacco' refers to tobacco that has not undergone the treatment process.

The treated tobacco material has an aerobic plate count (APC) of up to about 1000 colony forming units (CFU)/g. In some embodiments, the treated tobacco has an APC of up to about 900 CFU/g, up to about 800 CFU/g, up to about 700 CFU/g, up to about 600 CFU/g, up to about 500 CFU/g, up to about 400 CFU/g, up to about 300 CFU/g, up to about 200 CFU/g, up to about 100 CFU/g, up to about 90 CFU/g, up to about 80 CFU/g, up to about 70 CFU/g, up to about 60 CFU/g, up to about 50 CFU/g, up to about 40 CFU/g, up to about 30 CFU/g, up to about 20 CFU/g or up to about 10 CFU/g.

In some embodiments, the treated tobacco may have a low microbial content. As used herein, the term 'microbial content' refers to the amount of microorganisms present. The term 'microbial' may be used interchangeably with the term 'microbiological'.

In some embodiments, the APC of the tobacco material may represent the microbial content of the tobacco material. In some embodiments, an APC of up to about 1000 CFU/g may be considered to be a low microbial content. In some embodiments, an APC of up to about 100 CFU/g may be considered to be a low microbial content. In some embodiments, an APC of up to about 20 CFU/g may be considered to be a low microbial content.

In some embodiments, the microbial content of the treated tobacco material is lower than the microbial content of the untreated tobacco material.

Alternatively or in addition, the treated tobacco may have a low mould content. The treated tobacco may have a mould content of up to about 10 CFU/g. In some embodiments, the mould content of the treated tobacco is less than 10 CFU/g, less than 8 CFU/g, less than 6 CFU/g, less than 4 CFU/g or less than 2 CFU/g. The mould content of the treated tobacco may be lower than and/or about the same level as the mould content of the untreated tobacco material.

Alternatively or in addition, the treated tobacco may have a low yeast content. The treated tobacco may have a yeast content of up to about 10 CFU/g. In some embodiments, the yeast content of the treated tobacco is less than 10 CFU/g, less than 8 CFU/g, less than 6 CFU/g, less than 4 CFU/g or less than 2 CFU/g. The yeast content of the treated tobacco may be lower than and/or about the same level as the yeast content of the untreated tobacco material.

Alternatively or in addition, the treated tobacco may have a low coliform content. The treated tobacco may have a coliform bacteria content of up to about 10 CFU/g at 35° C. and/or 45° C. In some embodiments, the coliform content of the treated tobacco is less than 10 CFU/g, less than 8 CFU/g, less than 6 CFU/g, less than 4 CFU/g or less than 2 CFU/g at 35° C. and/or 45° C. In some embodiments, the coliform content of the treated tobacco is o CFU/g at 35° C. and/or 45° C. The coliform content of the treated tobacco may be lower than and/or about the same level as the coliform content of the untreated tobacco material.

The low microbial, mould, yeast and/or coliform content of the treated tobacco material may have the effect that the tobacco material is in a good physical state and/or is well preserved. The low microbial, mould, yeast and/or coliform content may minimise the occurrence of decay and/or rot in the tobacco material, thus minimising the need to discard decayed and/or rotten tobacco material, offering considerable advantages in terms of waste reduction and costs.

In some embodiments, the microbial composition of the treated tobacco material may differ from the microbial composition of the untreated tobacco material.

Tobacco undergoes a number of steps prior to consumption by the consumer. On the field the following steps are usually carried out by the farmer: seeding; transplanting; growing; harvesting; and curing.

Tobacco is generally cured after harvesting to reduce the moisture content of the tobacco, usually from around 80% to around 20% or lower. Tobacco can be cured in a number of different ways, including air-, fire-, flue- and sun-curing. During the curing period, the tobacco undergoes certain chemical changes and turns from a green colour to yellow, orange or brown. The temperature, relative humidity and packing density are carefully controlled to try to prevent houseburn and rot, which are common problems encountered during curing. Houseburn results in excessive losses in dry weight resulting primarily from the action of microorganisms.

At a Green Leaf Threshing (GLT) plant the tobacco is sold by the farmer and then usually undergoes the following steps: re-grading; green-leaf blending; conditioning; stem removal by de-stemming or threshing (or not in the case of whole leaf); drying; and packing.

Usually after curing, the stem may be removed from the lamina. This may be done by threshing, in which the midribs and partially the lamina ribs are separated from the lamina by machine threshing. An alternative way to remove the stem from lamina is manually, with the so-called 'hand stripping' process. Alternatively, tobacco may be 'butted', which means that the thick part of the stem is cut, while the rest of the tobacco leaf remains integral.

The tobacco may be further processed to enhance its taste and aroma. Aging and fermentation are known techniques for enhancing the taste and aroma of tobacco. These processes can be applied to tobacco materials such as threshed lamina, hand-stripped lamina, butted lamina and/or whole leaf tobacco.

Aging usually takes place after the tobacco has been cured, threshed (or butted or hand-stripped) and packed. Tobaccos that undergo aging include Oriental, flue-cured and air-cured tobaccos. During aging the tobacco might be stored generally at temperatures of around 20° C. to around 40° C. and relative humidities present at the respective country of origin/aging or under controlled warehouse conditions for around 1 to 3 years.

It is important that the moisture content of the tobacco is kept at a relatively low level during aging, for example up to around 10-13%, as mould will form in tobacco with higher moisture content.

Fermentation is a process that is applied to particular tobaccos, including dark air-cured tobacco, cured Oriental tobacco and cigar tobacco, to give the tobacco a more uniform colour and to change the aroma and taste. Fermentation is generally not applied to flue-cured and light air-cured tobacco.

The fermentation parameters, such as the moisture content of the tobacco and the ambient conditions, vary depending on the type of tobacco that is undergoing fermentation. Generally, the fermentation moisture is either similar to the moisture content of the tobacco when it has been received from the farmer (around 16-20%), or the tobacco is conditioned to a slightly higher moisture content. Care has to be taken to avoid the production of different rots, which occur when the tobacco is fermented at a moisture content that is too high. The duration of the fermentation period can vary, ranging from several weeks to several years.

Generally, fermentation involves the treatment of tobacco in large volumes and is applied to whole leaf, with subsequent removal of the stem after process. The tobacco can be arranged into large piles, which is then turned at intervals to move the tobacco at the periphery into the centre of the pile. Alternatively, the tobacco is placed into chambers with a volume of several square meters. Treatment of such large volumes of tobacco can be cumbersome and/or time-consuming.

The density of the tobacco during fermentation is generally around 150 to 200 kg/m$^3$ (on a dry matter weight base). For comparison, the density of cut rag tobacco may be as low as 70 kg/m$^3$ and is more likely to be from about 80 to 90 kg/m$^3$.

Significantly, fermentation relies on the activity of microorganisms to effect changes in the tobacco material and the fermentation conditions, including temperature and moisture content of the tobacco, are selected to enhance the microbiological activity during fermentation. In most, if not all, cases the fermentation of tobacco relies upon microorganisms already present in the tobacco material. However, suitable microorganisms could potentially be added to the tobacco material at the start of the fermentation process.

After the above treatments, generally the tobacco is transported to other locations to be further processed, for example before it is incorporated into a tobacco-containing product. When the tobacco is being incorporated into a smoking article such as a cigarette, the tobacco is generally unpacked, conditioned, blended with other tobacco styles and/or types and/or varieties, cut, dried, blended other tobacco materials, such as dry-ice-expanded-tobacco, and handed over to the cigarette manufacturing department.

Tobacco may additionally or alternatively be treated with additives to improve or enhance the flavour and aroma of the tobacco. However, this requires additional processing steps and apparatus, making the tobacco preparation process more lengthy and often more costly. In addition, it can be desirable to have a tobacco material that has a taste and aroma that is enjoyed by consumers but has not had any additives applied to it to achieve this. This would be the case for consumers who would like a natural tobacco product that also has a pleasant flavour and/or taste, for example. Additives are generally applied in the location at which the smoking article is being produced, such as a cigarette factory, although the point at which additives are applied can vary.

In some embodiments, the process of treating tobacco material as described herein produces a tobacco material with desirable organoleptic properties and with a low microbial content without the addition of flavour or aromatising additives.

In some embodiments, the process of treating tobacco material as described herein produces a tobacco material with a low microbial content without the addition of substances to control and/or limit microbial growth in the tobacco material.

In some embodiments, the process of treating the tobacco material preserves the tobacco material, for example by reducing the risk of subsequent infestation. In some embodiments, the treated tobacco material has a microbial content similar to that of tobacco material that has been pasteurised, but the treatment described herein is a gentler and/or more natural process than conventional pasteurisation techniques.

In some embodiments, the process of the present invention involves no fermentation or essentially no fermentation. This may be demonstrated by the absence of microbial content of the tobacco material at the end of the process.

As used herein, the term 'tobacco material' includes any part and any related by-product, such as for example the leaves or stems, of any member of the genus *Nicotiana*. The tobacco material for use in the present invention is preferably from the species *Nicotiana tabacum*.

Any type, style and/or variety of tobacco may be treated. Examples of tobacco which may be used include but are not limited to Virginia, Burley, Oriental, Comum, Amarelinho and Maryland tobaccos, and blends of any of these types. The skilled person will be aware that the treatment of different types, styles and/or varieties will result in tobacco with different organoleptic properties and/or with different TSNA contents.

The tobacco material may be pre-treated according to known practices.

The tobacco material to be treated may comprise and/or consist of post-curing tobacco. As used herein, the term 'post-curing tobacco' refers to tobacco that has been cured but has not undergone any further treatment process to alter the taste and/or aroma of the tobacco material. The post-curing tobacco may have been blended with other varieties and types. Post-curing tobacco does not comprise or consist of cut rag tobacco.

Alternatively or in addition, the tobacco material to be treated may comprise and/or consist of tobacco that has been processed to a stage that takes place at a Green Leaf Threshing (GLT) plant. This may comprise tobacco that has been re-graded, green-leaf blended, conditioned, de-stemmed or threshed (or not in the case of whole leaf), dried and/or packed.

In some embodiments, the tobacco material comprises lamina tobacco material. The tobacco may comprise between about 70% and 100% lamina material.

The tobacco material may comprise up to 50%, up to 60%, up to 70%, up to 80%, up to 90%, or up to 100% lamina tobacco material. In some embodiments, the tobacco material comprises up to 100% lamina tobacco material. In other words, the tobacco material may comprise substantially entirely or entirely lamina tobacco material.

Alternatively or in addition, the tobacco material may comprise at least 50%, at least 60%, at least 70%, at least 80%, at least 90%, or at least 95% lamina tobacco material.

When the tobacco material comprises lamina tobacco material, the lamina may be in whole leaf form. In some embodiments, the tobacco material comprises cured whole leaf tobacco. In some embodiments, the tobacco material substantially comprises cured whole leaf tobacco. In some embodiments, the tobacco material consists essentially of cured whole leaf tobacco. In some embodiments, the tobacco material does not comprise cut rag tobacco.

In some embodiments, the tobacco material comprises stem tobacco material. The tobacco may comprise between about 90% and 100% stem material.

The tobacco material may comprise up to 50%, up to 60%, up to 70%, up to 80%, up to 90%, or up to 100% stem tobacco material. In some embodiments, the tobacco material comprises up to 100% stem tobacco material. In other words, the tobacco material may comprise substantially entirely or entirely stem tobacco material.

Alternatively or in addition, the tobacco material may comprise at least 50%, at least 60%, at least 70%, at least 80%, at least 90%, or at least 95% stem tobacco material.

The moisture content of the tobacco material before and during treatment is between about 10% and about 15.5%. As used herein, the term 'moisture content' refers to the percentage of oven volatiles present in the tobacco material.

In some embodiments, the moisture content of the tobacco is between about 10% and 15.5%, optionally between about 11% and 15% or between about 12% and 14%. The moisture content of the tobacco may be about 10%, about 11%, about 12%, about 13%, about 14% or about 15%.

In some embodiments, it is not necessary to redry the tobacco following the treatment process.

The tobacco material is secured within a moisture-retaining material, to limit moisture losses and to retain a desired level of moisture during the process.

The tobacco may be completely sealed within the moisture-retaining material. Alternatively, the tobacco material may not be completely sealed within the moisture-retaining material. In some embodiments, a moisture-retaining material is wrapped around the tobacco material. In some embodiments, the tobacco material is placed within a moisture-retaining container.

The moisture-retaining material may be any material that is sufficiently impermeable to moisture to retain the desired amount of moisture during the treatment process. The amount of moisture that is retained in the tobacco material may be at least 70%, at least 75%, at least 80%, at least 85%, at least 90%, at least 91%, at least 92%, at least 93%, at least 94%, at least 95%, at least 96%, at least 97%, at least 98%, at least 99%, at least 99.5% or 100% of the moisture which was present in the tobacco material prior to treatment. In some embodiments, between 99% and 100% of the moisture content of the tobacco material is retained during the process.

It is desirable for the moisture-retaining material to be resistant to degradation during the tobacco treatment process. For example, it is desirable for the moisture-retaining material to withstand the temperatures of the treatment process, without breaking down to become moisture-permeable or to release compounds that may be taken up by the tobacco material. The temperature reached by the tobacco material during the process may therefore be taken into consideration when selecting the moisture-retaining material.

The moisture-retaining material may comprise a flexible material. This flexible material may be wrapped around the tobacco material and/or formed into a pouch into which the tobacco is placed. In some embodiments, the moisture-retaining material comprises plastic material. In some embodiments, the moisture-retaining material comprises flexible polymeric material, optionally a polymeric or plastic film. In some embodiments, the moisture-retaining material comprises polyethylene. In some embodiments, the moisture-retaining material comprises polyesters, nylon and/or polypropylene. In some embodiments, the moisture-retaining material is Polyliner®. Polyliner® is available through a number of suppliers, including Plastrela Flexible Packaging, located in Brazil.

Alternatively or in addition, the moisture-retaining material may comprise a rigid material, such as metal for example, which is formed into a vessel or container. In these embodiments, a separate storage container as discussed below may not be required.

In embodiments where the tobacco material reaches a temperature of about 100° C. or above, the moisture-retaining material may be pressure-resistant.

The moisture-retaining material may assist in and/or affect the microbial content and/or microbial composition of the treated tobacco material. In some embodiments, the moisture-retaining material may prevent or reduce the repopulation of the tobacco material with microorganisms.

At the start of the process, the tobacco material has a packing density of at least 200 kg/m$^3$ (on a dry matter weight base). Additionally or alternatively, at the start of the process, the tobacco material may have a packing density of up to about 500 kg/m$^3$ (on a dry matter weight base). The tobacco material may have a packing density of between about 200 kg/m$^3$ and 330 kg/m$^3$, optionally between about 220 kg/m$^3$ and 330 kg/m$^3$. In some embodiments, the tobacco material has a packing density of between about 260 kg/m$^3$ and 300 kg/m$^3$, a packing density of about 200 to about 400 kg/m$^3$, or a packing density of about 250 to about 300 kg/m$^3$.

The packing density of the tobacco material may be at least 210 kg/m$^3$, at least 220 kg/m$^3$, at least 230 kg/m$^3$, at least 240 kg/m$^3$, at least 250 kg/m$^3$, at least 260 kg/m$^3$, at least 270 kg/m$^3$, at least 280 kg/m$^3$, at least 290 kg/m$^3$, at least 300 kg/m$^3$, at least 310 kg/m$^3$, at least 320 kg/m$^3$ or at least 330 kg/m$^3$.

Alternatively or in addition, the packing density of the tobacco material may be up to 220 kg/m$^3$, up to 230 kg/m$^3$, up to 240 kg/m$^3$, up to 250 kg/m$^3$, up to 260 kg/m$^3$, up to 270 kg/m$^3$, up to 280 kg/m$^3$, up to 290 kg/m$^3$, up to 300 kg/m$^3$, up to 310 kg/m$^3$, up to 320 kg/m$^3$ or up to 330 kg/m$^3$.

The packing density of the tobacco material during and/or following treatment may be similar or substantially similar to the packing density of the tobacco material at the start of the process.

The tobacco material may be placed in a storage container after it has been secured within a moisture-retaining material. Placing the secured tobacco in a container enables the tobacco to be handled easily.

The volume of the storage container may be selected to achieve the desired packing density for the desired amount of tobacco to be treated, and at the same time allows the treatment of the tobacco to take place at a suitable rate. Alternatively or in addition, the container may be oriented on its side. This arrangement may be particularly beneficial when the tobacco material comprises tobacco lamina that is in a horizontal position when placed in the storage container, as placing the storage container on its side achieves a more even packing density.

In some embodiments, the container has a volume of between about 0.2 m$^3$ and about 1.0 m$^3$, optionally between about 0.4 m$^3$ and about 0.8 m$^3$. In some embodiments, the container has a volume of about 0.6 m$^3$.

In some embodiments, the storage container is a case for tobacco known as a C-48 box. The C-48 box is generally made of cardboard and has dimensions of about 115×70×75 cm. A desirable packing density is achieved when 180-200 kg of tobacco with a moisture content of between about 12 and 15% is held within a C-48 box.

The tobacco may be placed in a tobacco processing area. As used herein, the term 'tobacco processing area' is the area, which can be a room or chamber, in which the treatment process is carried out. The ambient process conditions, i.e. the conditions of the tobacco processing area, may be controlled during the process. This may be achieved by placing the tobacco material secured within the moisture-retaining material into a controlled environment, such as a chamber. The tobacco material may be placed on one or more rack(s) within a chamber, to allow optimal ventilation to maintain constant ambient process conditions around the tobacco. The rack(s) may have one or more shelve(s) comprising bars with gaps between the bars and/or other apertures, to assist in the maintenance of constant ambient process conditions around the tobacco.

The ambient processing humidity may be maintained at a level to avoid significant moisture loss from the tobacco material. As used herein, the term 'ambient processing humidity' refers to the humidity of the tobacco processing area. As used herein, the term 'ambient relative processing humidity' refers to the relative humidity of the tobacco processing area.

In some embodiments, the ambient relative processing humidity is about 65%. The ambient relative processing humidity may be at least 40%, at least 45%, at least 50%, at least 55%, at least 60%, at least 65% or at least 70%.

The ambient processing temperature is at least about 45° C. In some embodiments, the ambient processing temperature is at least about 50° C. In some embodiments, the ambient processing temperature may be maintained at above 55° C., optionally at about 60° C. As used herein, the term 'ambient processing temperature' refers to the temperature of the tobacco processing area.

In some embodiments, the ambient processing temperature is at least 46° C., at least 47° C., at least 48° C., at least 49° C., at least 50° C., at least 51° C., at least 52° C., at least 53° C., at least 54° C., at least 55° C., at least 56° C., at least 57° C., at least 58° C., at least 59° C., at least 60° C., at least 61° C., at least 62° C., at least 63° C., at least 64° C., at least 65° C., at least 66° C., at least 67° C., at least 68° C., at least 69° C. or at least 70° C. In some embodiments, the ambient processing temperature is up to 60° C., up to 70° C., up to 75° C., up to 80° C., up to 85° C., up to 90° C., up to 95° C., up to 100° C., up to 105° C., up to 110° C., up to 115° C. or up to 120° C.

In embodiments in which the ambient processing temperature is about 45° C., the ambient processing humidity may be about 30-70 g water/m$^3$. In embodiments in which the ambient processing temperature is about 55° C., the ambient processing humidity may be about 40-80 g water/m$^3$. In embodiments in which the ambient processing temperature is about 60° C., the ambient processing humidity may be about 50-110 g water/m$^3$. In embodiments in which the ambient processing temperature is about 70° C., the ambient processing humidity may be about 50-160 g water/m$^3$. In embodiments in which the ambient processing temperature is about 80° C., the ambient processing humidity may be about 50-230 g water/m$^3$. In embodiments in which the ambient processing temperature is about 90° C., the ambient processing humidity may be about 50-340 g water/m$^3$. In embodiments in which the ambient processing temperature is about 100° C. or higher, the ambient processing humidity may be about 50-500 g water/m$^3$.

In some embodiments, the ambient processing temperature is 60° C. and the ambient relative processing humidity is 60%.

During the process the temperature of the tobacco material reaches the ambient processing temperature. The tobacco material may reach the ambient processing temperature within a short period of time. The tobacco material may reach the ambient processing temperature within 4 to 10 days, optionally within 5 to 9 days, within 7 to 9 days and/or within 4 to 7 days.

To achieve this, the amount of tobacco treated may be optimised for the heat to be transferred to the centre of the tobacco material sufficiently rapidly. The rate at which the temperature of the tobacco material rises and reaches the ambient processing temperature will be dependent upon a number of factors, including the ambient processing temperature, the density of the tobacco and the overall amount of tobacco being treated.

In some embodiments, the tobacco material reaches a temperature of above 55° C. and/or at least 60° C. within about 9 days. In some embodiments, the tobacco material reaches a temperature of above 55° C. and/or at least 60° C. within about 7 days. In some embodiments, the tobacco material reaches a temperature of above 55° C. and/or at least 60° C. within about 5 days. In such embodiments, the ambient processing temperature may be 60° C. In such embodiments, the tobacco may be treated in 200 kg batches.

In some embodiments, the temperature to which the tobacco material is raised is at least about 55° C. or at least about 60° C. Additionally or alternatively, the temperature to which the tobacco material should be raised may be up to about 80° C., up to about 85° C., up to about 90° C., up to about 95° C., or up to about 100° C.

In some embodiments, the beneficial effects of the processing according to the invention may be achieved within shorter processing periods by employing a higher ambient processing temperature.

In some embodiments, the temperature of the tobacco material may rise during the treatment process, to reach a second temperature that is higher than ambient processing temperature. This may be achieved with the assistance of exothermic reactions taking place during the treatment process.

In some embodiments, the tobacco material reaches a second temperature which is above the ambient processing temperature. In some embodiments, the second temperature is at least 1° C. above the ambient processing temperature, at least 2° C., at least 3° C., at least 4° C., at least 5° C., at least 7° C., at least 10° C., at least 12° C., at least 15° C., at least 17° C. or at least 20° C. above the ambient processing temperature. In some embodiments, the tobacco material reaches a second temperature which is above the ambient processing temperature within about 7 to 13 days, and/or the second temperature is reached within about 13 days or within about 11 days. In some embodiments, the tobacco material reaches a second temperature of at least 5° C. above the ambient temperature within about 11 to 13 days.

The temperature of the tobacco material may reach up to 60° C., up to 65° C., up to 70° C., up to 75° C., up to 80° C., up to 85° C., up to 90° C., up to 95° C., up to 100° C., up to 105° C., up to 110° C., up to 115° C., up to 120° C., up to 125° C., up to 130° C., up to 135° C., up to 140° C., up to 145° C. or up to 150° C. during the treatment process.

Alternatively or in addition, the temperature of the tobacco material may reach at least 60° C., at least 65° C., at least 70° C., at least 75° C., at least 80° C., at least 85° C., at least 90° C., at least 95° C., at least 100° C., at least 105° C., at least 110° C., at least 115° C., at least 120° C., at least 125° C., at least 130° C., at least 135° C., at least 140° C., at least 145° C. or at least 150° C. during the treatment process. In practice, the upper temperature may be limited by the thermal tolerance of the moisture-retaining material.

In some embodiments, the temperature of the tobacco material may reach between about 55° C. and about 90° C., between about 55° C. and about 80° C., or between 60° C. and about 70° C.

The tobacco may be secured within the moisture-retaining material for a sufficiently long period of time for the tobacco to develop the desirable organoleptic properties, and for a sufficiently short period of time to not cause unwanted delay in the tobacco supply chain.

The tobacco material is secured within the moisture-retaining material for a period of time and at an ambient processing temperature and ambient processing humidity suitable to give rise to an increase in the temperature of the tobacco to or above a threshold temperature, wherein the moisture content of the tobacco is between about 10% and 23%. In some embodiments, the threshold temperature is 55° C., 60° C. or 65° C.

In some embodiments, the tobacco is secured within the moisture-retaining material for between about 5 and 65 days, for between about 8 to 40 days, for between about 10 and 40 days, between about 15 and 40 days, between about 20 and 40 days between about 25 and 35 days and/or between about 28 and 32 days. The tobacco may be secured within the moisture-retaining material for between about 10 to 12 days. In other embodiments, the tobacco is secured within the moisture-retaining material for between about 5 and 16 days, optionally between about 6 and 12 days, or between about 8 and 10 days.

In some embodiments, the tobacco is secured within the moisture-retaining material for at least 4 days, at least 5 days, at least 6 days, at least 7 days, at least 8 days, at least 9 days, at least 10 days, at least 11 days, at least 12 days, at least 13 days, at least 14 days, at least 15 days, at least 16 days, at least 17 days, at least 18 days, at least 19 days, at least 20 days, at least 21 days, at least 22 days, at least 23 days, at least 24 days, at least 25 days, at least 26 days, at least 27 days, at least 28 days, at least 29 days, at least 30 days, at least 31 days, at least 32 days, at least 33 days, at least 34 days, at least 35 days, at least 36 days, at least 37 days, at least 38 days, at least 39 days, at least 40 days, at least 41 days, at least 42 days, at least 43 days, at least 44 days or at least 45 days.

In some embodiments, the tobacco is secured within the moisture-retaining material for up to 5 days, up to 6 days, up to 7 days, up to 8 days, up to 9 days, up to 10 days, up to 11 days, up to 12 days, up to 13 days, up to 14 days, up to 15 days, up to 16 days, up to 17 days, up to 18 days, up to 19 days, up to 20 days, up to 21 days, up to 22 days, up to 23 days, up to 24 days, up to 25 days, up to 26 days, up to 27 days, up to 28 days, up to 29 days, up to 30 days, up to 31 days, up to 32 days, up to 33 days, up to 34 days, up to 35 days, up to 36 days, up to 37 days, up to 38 days, up to 39 days, up to 40 days, up to 41 days, up to 42 days, up to 43 days, up to 44 days, up to 45 days, up to 46 days, up to 47 days, up to 48 days, up to 49 days, up to 50 days, up to 51 days, up to 52 days, up to 53 days, up to 54 days, up to 55 days, up to 56 days, up to 57 days, up to 58 days, up to 59 days, up to 60 days, up to 61 days, up to 62 days, up to 63 days, up to 64 days or up to 65 days.

Embodiments in which the tobacco material reaches a higher temperature may require a shorter process period than embodiments in which the tobacco material reaches a lower temperature. In some embodiments, the temperature reached by the tobacco material during the process is about 5° C. above the ambient processing temperature, or between about 2 and 5° C. above the ambient processing temperature and the process takes place over a total of 25 to 35 days or a total of 20 to 30 days. In other embodiments, the temperature reached by the tobacco material during the process is between about 2 and 5° C. above the ambient processing temperature and the process takes place over a total of 5 to 16 days, a total of 6 to 15 days or a total of 8 to 12 days.

In some embodiments, the tobacco material is treated so that it is held at the threshold temperature for a relatively short period of time. In some embodiments, the process is halted about 6 hours, 12 hours, 18 hours, 24 hours, or 2, 3, 4, 5, 6, 7 or 8 days after the temperature of the tobacco material reaches a threshold temperature. In some embodiments, the threshold temperature is 55° C., 60° C., or 65° C. The period of time for which the tobacco material is maintained at or above the threshold temperature may influence the manner and extent to which the tobacco material is changed by the process. The threshold temperature may differ for different types of tobacco. The period for which the tobacco is maintained at or above the threshold temperature may differ for different types of tobacco.

In other embodiments, the tobacco material is treated so that it is held at the threshold temperature for a longer period of time. In some embodiments, the process is halted no less than 12 days after the temperature of the tobacco material reaches a threshold temperature. In some embodiments, the threshold temperature is 55° C., 60° C., or 65° C. The period of time for which the tobacco material is maintained at or above the threshold temperature may influence the manner and extent to which the properties of the tobacco material are changed by the process. The threshold temperature may differ for different types of tobacco. The period for which the tobacco is maintained at or above the threshold temperature may differ for different types of tobacco.

In other embodiments, the process involves treating the tobacco material until the temperature of the tobacco material reaches a target temperature, and then allowing the tobacco material to cool. This cooling may be effected by removing the tobacco material from the processing area which is being held at an elevated temperature. In some embodiments, the target temperature is 60° C., 61° C., 62° C., 63° C., 64° C., 65° C., 66° C., 67° C., 68° C., 69° C. or 70° C. In some embodiments, the target temperature is within the range of 62 to 67° C. The target temperature may differ for different types of tobacco.

In some embodiments the tobacco material is treated so that it has desirable organoleptic properties that are produced in a reliable way and at relatively high volumes. In some embodiments, the process is a batch process.

In an embodiment, 180-200 kg of tobacco material with a moisture content of 12 to 14% is wrapped in Polyliner® material and placed in a C-48 carton. The C-48 carton is placed within a chamber that maintains the relative processing humidity at 60% and the ambient processing temperature at 60° C. After a period of 5 to 9 days the temperature of the tobacco material reaches a temperature of about 60° C. and then continues to rise, to reach up a temperature of at least 5° C. above the ambient processing temperature after 7 to 13 days. The tobacco material is incubated for a total of 25 to 35 days.

After the tobacco has been incubated for the desired length of time, the treated tobacco may be cooled down while remaining in the moisture-retaining material.

The process parameters are sufficiently gentle for the treated tobacco material to maintain some or all of its physical properties. For example, the tobacco material remains sufficiently intact following treatment to allow handling and/or processing for incorporation into a tobacco-containing product, such as a smoking article. This enables the treated tobacco material to undergo handling in accordance with standard processes.

Figure 2:
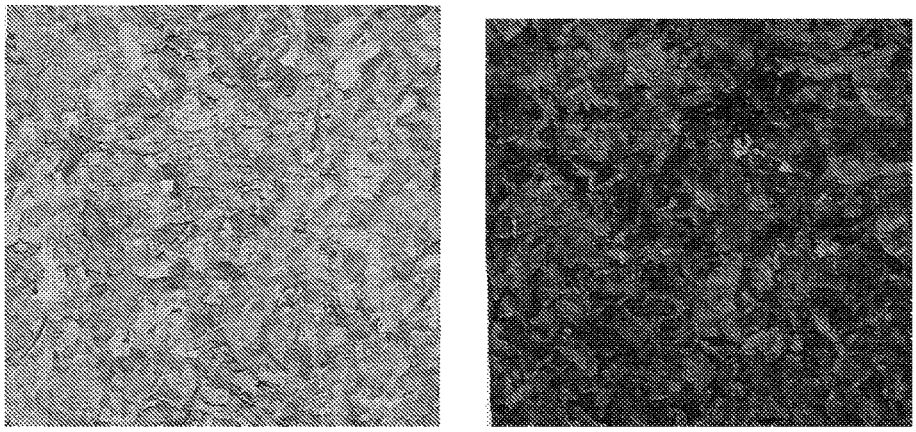
FIG. 2 is a close-up view of the tobacco shown in FIG. 1.

The treated tobacco material may have a different colour from untreated tobacco material. In some embodiments, the tobacco material is darker than untreated tobacco material. This can be seen in FIGS. 1 and 2, in which the untreated tobacco on the left of the Figures is lighter than the treated tobacco on the right of the Figures.

As can be seen from Example 2 below, analysis of the treated tobacco material surprisingly showed in some embodiments that the treated tobacco material has a low or very low microbial content. This is particularly remarkable in view of the mould and rot problems that can be encountered in other processes in which moist tobacco is incubated, such as aging and fermentation. In Example 2 after the tobacco material was wrapped in a moisture-retaining material and exposed to an ambient processing temperature of 60° C. for 30 days, the APC was reduced significantly down to 20 CFU/g, the mould content was less than 10 CFU/g, the yeast content was less than 10 CFU/g and no coliform CFU were observed at 35° C. or 45° C. All of these measurements after processing are so low that they are close to or even below the limit of detection.

In some embodiments the treated tobacco material has organoleptic properties that are acceptable and/or desirable for the consumer. Thus, tobacco material with desirable organoleptic properties can be produced by the treatment of tobacco under a specific set of conditions, and without requiring the addition of one or more further chemical(s), which may be hazardous and/or expensive. Moreover, the treated tobacco does not need to undergo an additional treatment step to remove the further chemical(s), which would add extra cost and time to the tobacco treatment process.

The organoleptic properties of the treated tobacco material may be developed when the tobacco material is secured within the moisture-retaining material, during which period the components in the tobacco material undergo chemical changes and modifications, to give desirable organoleptic characteristics to the final product.

In some embodiments the chemical composition of the treated tobacco material differs significantly from untreated tobacco material. In some embodiments the majority of the sugars in the treated tobacco material are converted. In addition, in some embodiments the smoke generated out of the processed material incorporated into a smoking article such as a cigarette contains increased levels of pyrazine and alkylpyrazines. In some embodiments the treated tobacco material contains increased levels of 2,5 deoxyfructosazine and 2,6 deoxyfructosazine, compared with untreated tobacco material. The treated tobacco material may, in some embodiments, contain a reduced level of nicotine compared with untreated tobacco material. The altered levels of these compounds may contribute to the desirable taste and aroma of the treated tobacco material.

Without being bound by theory, it is thought that the change in the levels of at least some of these compounds is due at least in part to the Maillard reaction taking place during the process. A caramelisation reaction may also be taking place during the process, which may lead to reduced levels of reducing and non-reducing sugars.

In addition, in some embodiments a significant decrease in the content of various amino acids may be seen.

The production of a tobacco material with desirable organoleptic properties advantageously removes the requirement to add further substances to the tobacco to provide or enhance its organoleptic properties. Such substances include flavourants and/or aromatising ingredients.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The treated tobacco material may be incorporated into a smoking article. As used herein, the term 'smoking article' includes smokeable products such as cigarettes, cigars and cigarillos whether based on tobacco, tobacco derivatives, expanded tobacco, reconstituted tobacco or tobacco substitutes and also heat-not-burn products.

The treated tobacco material may be used for roll-your-own tobacco and/or pipe tobacco.

The treated tobacco material may be incorporated into a smokeless tobacco product. 'Smokeless tobacco product' is used herein to denote any tobacco product which is not intended for combustion. This includes any smokeless tobacco product designed to be placed in the oral cavity of a user for a limited period of time, during which there is contact between the user's saliva and the product.

The treated tobacco material may be blended with one or more tobacco materials before being incorporated into a smoking article or smokeless tobacco product or used for roll-your-own or pipe tobacco.

In some embodiments, tobacco extracts may be created from tobacco material which has undergone the processing described herein. In some embodiments, the extract may be a liquid, for example it may be an aqueous extract. In other embodiments, the extract may be produced by supercritical fluid extraction.

In some embodiments, the extracts may be used in nicotine delivery systems such as inhalers, aerosol generation devices including e-cigarettes, lozenges and gum. For example, the tobacco extracts may be heated to create an inhalable vapour in an electronic cigarette or similar device. Alternatively, the extracts may be added to tobacco or another material for combustion in a smoking article or for heating in a heat-not-burn product.

In order to address various issues and advance the art, the entirety of this disclosure shows by way of illustration various embodiments in which the claimed invention(s) may be practiced and provide for superior tobacco treatment processes. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

EXAMPLES

The present invention is illustrated in greater detail by the following specific Examples. It is to be understood that these Examples are illustrative embodiments and that this invention is not to be limited by any of the Examples.

Example 1—Treatment of Tobacco

Virginia tobacco was green-leaf blended and threshed, conditioned and packed in a C-48 box at 200 kg and 13% oven volatiles moisture (3 hours at 110° C.), wrapped with polyethylene liner (Polyliner®), and was set to rest for a minimum period of 30 days before being exposed to the ambient processing conditions of 60° C. and 60% relative humidity and a process time of 30 days.

Example 2—Analysis of Microbial Content

The microbial analysis of the treated tobacco was conducted by using Petrifilm® Yeast and Mould Count Plates for moulds and yeasts, Petrifilm® Aerobic Count Plates for total bacteria, and the most probable number (MPN) method for coliforms. The results of the analysis are provided in Table 1. The results show that the microbial content of the treated tobacco is very low, with no coliform CFUs observed in the treated tobacco after incubation at 35° C. or 45° C., and very low numbers of CFUs observed for moulds and yeasts and in the aerobic plate count.

TABLE 1

Microbial analysis of tobacco before and after treatment

| | Time | Aerobic Plate Count (CFU/g) | Moulds (CFU/g) | Yeasts (CFU/g) | Coliforms 35° C. (CFU/g) | Coliforms 45° C. (CFU/g) |
|---|---|---|---|---|---|---|
| Sample 1 | Before process | 1.80E+05 | 1.23E+03 | 3.33E+01 | 4.83E+02 | non observed |
| Sample 2 | Before process | 1.80E+05 | 9.33E+02 | 3.33E+01 | 6.40E+02 | non observed |
| Sample 1 | After process (14 days) | <10* | <10* | <10* | non observed | non observed |
| Sample 2 | After process (14 days) | 2.00E+01 | <10* | <10* | non observed | non observed |
| Sample 1 | After process (42 days) | 6.66E+00 | <10* | <10* | non observed | non observed |

TABLE 1-continued

| Microbial analysis of tobacco before and after treatment | | | | | | |
|---|---|---|---|---|---|---|
| | Time | Aerobic Plate Count (CFU/g) | Moulds (CFU/g) | Yeasts (CFU/g) | Coliforms 35° C. (CFU/g) | Coliforms 45° C. (CFU/g) |
| Sample 2 | After process (42 days) | 6.66E+00 | <10* | <10* | non observed | non observed |

*<10 = below detection limit

The invention claimed is:

1. A process for treating tobacco material wherein the treated tobacco material has an aerobic plate count of up to about 1000 CFU/g, the process comprising securing tobacco material within a moisture-retaining material and exposing the tobacco material to an ambient processing temperature of at least about 45° C. whilst secured within the moisture-retaining material, wherein the tobacco material has a packing density on a dry matter weight base of between about 200 kg/m$^3$ and about 500 kg/m$^3$ at the start of the process and has a moisture content of between about 10% and 15.5% before and during treatment.

2. The process according to claim 1, wherein the microbial content of the treated tobacco material is lower than the microbial content of untreated tobacco material.

3. The process according to claim 1, wherein the tobacco material is secured within the moisture-retaining material for between about 5 and 65 days.

4. The process according to claim 1, wherein the tobacco material is exposed to an ambient processing temperature of above 55° C.

5. The process according to claim 1, wherein the treated tobacco material has been exposed to an ambient processing temperature of at least about 45° C. for between 10 days and 65 days whilst secured within the moisture retaining material.

6. The process according to claim 1, wherein the treated tobacco material has been exposed to an ambient processing temperature of at least about 45° C. for between about 10 and 40 days whilst secured within the moisture retaining material.

7. The process according to claim 5, wherein the temperature of the tobacco material reaches the ambient processing temperature within about 4 to 10 days.

8. The process according to claim 1, wherein the ambient processing humidity is between about 50-500 g water/m$^3$ for ambient processing temperatures around or above 100° C., about 50-340 g water/m$^3$ for ambient processing temperatures around 90° C., about 50-230 g water/m$^3$ for ambient processing temperatures around 80° C., about 50-160 g water/m$^3$ for ambient processing temperatures around 70° C., about 50-110 g water/m$^3$ for ambient processing temperatures around 60° C., about 40-80 g water/m$^3$ for ambient processing temperatures around 55° C. or about 30-70 g water/m$^3$ for ambient processing temperatures around 45° C.

9. The process according to claim 1, wherein the moisture-retaining material is wrapped around the tobacco material.

10. The process according to claim 9, wherein the moisture-retaining material comprises flexible polymeric material.

11. The process according to claim 10, wherein the flexible polymeric material comprises polyethylene.

12. The process according to claim 1, wherein the tobacco material secured within the moisture-retaining material is placed in a chamber to control the ambient processing temperature and/or ambient processing humidity.

13. The process according to claim 1, wherein the tobacco material comprises whole leaf tobacco.

14. The process according to claim 1, wherein the tobacco material does not comprise cut rag tobacco.

15. The process according to claim 1, wherein the tobacco material is post-curing tobacco.

16. The process according to claim 1, wherein the treated tobacco material has an aerobic plate count of up to about 100 CFU/g.

17. A process according to claim 1, wherein the process further comprises manufacturing a smoking article or a smokeless tobacco product from the treated tobacco material.

18. A process according to claim 1, wherein the process further comprises manufacturing a tobacco extract from the treated tobacco material.

19. A process according to claim 1, wherein the tobacco material secured within the moisture retaining material has been exposed to an ambient processing temperature during the process of above 55° C. for between 10 days and 65 days.

20. A process according to claim 19, wherein the temperature of the tobacco material reaches the ambient processing temperature within about 4 to 10 days.

21. A process according to claim 1, wherein the tobacco material secured within the moisture retaining material has been exposed to an ambient processing temperature during the process of above 55° C. for between about 10 and 40 days.

22. A tobacco material secured within a moisture-retaining material, wherein the tobacco material has been exposed to an ambient processing temperature of at least about 45° C. whilst secured within the moisture retaining material, has a packing density on a dry matter weight base of between about 200 kg/m$^3$ and about 500 kg/m$^3$ and a moisture content of between about 10% and 15.5%, and wherein the tobacco material has an aerobic plate count of up to about 1000 CFU/g.

23. A tobacco material according to claim 22, wherein the tobacco material has an aerobic plate count of up to about 100 CFU/g.

24. The tobacco material according to claim 22, wherein the microbial content of the tobacco material is lower than the microbial content of tobacco material prior to being secured within a moisture-retaining material and exposed to an ambient processing temperature of at least about 45° C.

25. The tobacco material according to claim 22, wherein the treated tobacco material has been exposed to an ambient processing temperature of above 55° C. whilst secured within the moisture retaining material.

* * * * *